US009907355B2

(12) United States Patent
Barnes et al.

(10) Patent No.: US 9,907,355 B2
(45) Date of Patent: Mar. 6, 2018

(54) ARTICLE OF FOOTWEAR FOR RUNNING AND CYCLING

(71) Applicant: NIKE, Inc., Beaverton, OR (US)

(72) Inventors: Elizabeth Barnes, Portland, OR (US); Deborah L. Lawless, Portland, OR (US); Gregory R. Leedy, Milwaukie, OR (US)

(73) Assignee: NIKE, Inc., Beaverton, OR (US)

( * ) Notice: Subject to any disclaimer, the term of this patent is extended or adjusted under 35 U.S.C. 154(b) by 447 days.

(21) Appl. No.: 14/559,403

(22) Filed: Dec. 3, 2014

(65) Prior Publication Data

US 2016/0157556 A1 Jun. 9, 2016

(51) Int. Cl.

| | |
|---|---|
| ***A43B 3/24*** | (2006.01) |
| ***A43B 13/16*** | (2006.01) |
| ***A43B 13/36*** | (2006.01) |
| ***A43B 5/14*** | (2006.01) |

(52) U.S. Cl.

CPC ..... *A43B 13/16* (2013.01); *A43B 3/246* (2013.01); *A43B 5/14* (2013.01); *A43B 13/36* (2013.01)

(58) Field of Classification Search

CPC ..... A43B 13/28; A43B 13/36; A43B 5/14; A43B 3/24; A43B 3/246

USPC ..... 36/15, 131

See application file for complete search history.

(56) References Cited

U.S. PATENT DOCUMENTS 3,538,628 A * 11/1970 Einstein ..... A43B 3/0078 36/1
4,267,650 A * 5/1981 Bauer ..... A43B 13/36 36/101
4,317,294 A * 3/1982 Goodyear ..... A43B 13/36 36/100
4,377,042 A * 3/1983 Bauer ..... A43B 13/36 36/101
5,848,482 A * 12/1998 Bathum ..... A43C 15/168 36/127

(Continued)

FOREIGN PATENT DOCUMENTS

DE 202013103832 U1 9/2013

OTHER PUBLICATIONS

International Search Report with Written Opinion dated Mar. 9, 2016 in PCT Application No. PCT/US2015/063770, 13 pages.

(Continued)

*Primary Examiner* — Marie Bays

(74) *Attorney, Agent, or Firm* — Shook, Hardy & Bacon L.L.P.

(57) ABSTRACT

An article of footwear may include a sole and a stability element. The sole may have a receiving channel extending from a sole bottom surface toward a sole top surface. The receiving channel may have a first groove at an outer perimeter of the receiving channel and a second groove at an inner perimeter of the receiving channel. The stability element may have a first tongue protruding from an outer perimeter of a body of the stability element and a second tongue protruding from an inner perimeter of the body of the stability element. In an exemplary aspect, the first groove of the receiving channel is configured to receive the first tongue of the stability element, and the second groove of the receiving channel is configured to receive the second tongue of the stability element as the stability element is maintained, at least in part, within the receiving channel.

20 Claims, 12 Drawing Sheets

(56) References Cited

U.S. PATENT DOCUMENTS

| | | | | |
|---|---|---|---|---|
| 7,246,453 | B2 * | 7/2007 | Kim | A43B 5/00 36/100 |
| 7,673,398 | B2 * | 3/2010 | Koo | A43C 15/161 36/134 |
| 2005/0210712 | A1 * | 9/2005 | Jau, Jr. | A43B 5/14 36/131 |
| 2006/0010716 | A1 * | 1/2006 | Kerns | A43B 5/14 36/25 R |
| 2006/0021260 | A1 | 2/2006 | Kim | |
| 2006/0130364 | A1 * | 6/2006 | Greene | A43B 3/24 36/28 |
| 2007/0227039 | A1 | 10/2007 | Chaney et al. | |
| 2008/0092409 | A1 * | 4/2008 | Koo | A43C 15/161 36/59 R |

OTHER PUBLICATIONS

International Preliminary Report on Patentability dated Jun. 15, 2017 in International Application No. PCT/US2015/063770, 8 pages.

* cited by examiner

ARTICLE OF FOOTWEAR FOR RUNNING AND CYCLING

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

Exemplary aspects hereof relate to an article of footwear for various athletic activities, such as ambulatory activities (e.g., walking, running) and cycling. More specifically, exemplary aspects relate to an article of footwear having a sole that is suitable for ambulatory activities and a stability element that, when coupled with the sole, enables a wearer of the article of footwear to engage clipless pedals for cycling. Other exemplary aspects relate to an article of footwear having a sole that is suitable for ambulatory activities and a stability element including features that are customized for a particular sport, such as a stability element that includes cleats for indoor soccer or a stability element that includes cleats for outdoor soccer.

BACKGROUND

Traditionally, athletes participating in both running and cycling activities wear one particular item of footwear for cycling, and then change into a different item of footwear for running. For example, while cycling, an athlete might wear cycling shoes that are adapted for use with clipless pedals. These shoes may not be suitable for running, and as such, before running, the athlete might change into running shoes having a flexible sole. Changing out of one item of footwear and into another may be inconvenient and time consuming. Additionally, acquiring multiple items of footwear may be expensive. All athletes, both competitive and casual, may be affected by this inconvenience and expense. In particular, a competitive athlete, such as a triathlete, may be affected, because minimizing both the amount of athletic equipment required for multiple activities and the transition time between activities may be important during timed competitions.

BRIEF DESCRIPTION OF THE DRAWINGS

The present disclosure makes reference to the attached drawing figures, wherein.

Corresponding reference numerals indicate corresponding parts throughout the several views of the drawings.

DETAILED DESCRIPTION

Figure 1:
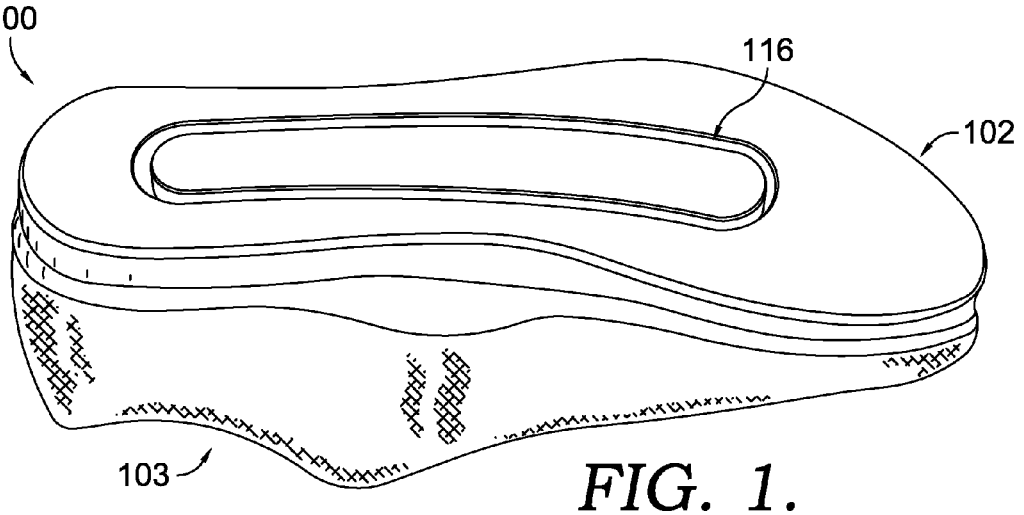
FIG. 1 depicts an article of footwear having an upper and a sole, where the sole includes a receiving channel, in accordance with an exemplary aspect hereof.

The subject matter hereof is described with specificity to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Aspects hereof provide an article of footwear, or a shoe, for running and cycling activities. At a high level, the shoe may include a sole that is made of a flexible and/or deformable material. Such a sole may be suitable for running activities. The sole of the shoe may include a receiving channel that removably receives a stability element, which may be constructed of substantially rigid material. In an exemplary aspect, the stability element is coupled with the sole of the shoe at the receiving channel by way of a tongue and groove configuration. The stability element may further include a clip receiving portion that allows a wearer of the shoe to engage a clipless pedal. In this way, the shoe may be worn with the stability element for purposes of clipping into clipless pedals during cycling activities. Then, when a wearer of the shoe wishes to transition to a running activity, where the ability to engage a clipless pedal is no longer needed and a flexible sole is desirable, the wearer may quickly and easily remove the stability element from the sole of the shoe. Because the stability element is, in an exemplary aspect, secured within the sole of the shoe by means of a compression fit, the stability element may be quickly coupled with the sole of the shoe, as well as quickly removed from the sole of the shoe, without the need for additional tools or hardware. In this way, a wearer of the shoe may quickly, easily, and conveniently switch from one activity to another, while wearing appropriate footwear for each. It should be noted that while exemplary aspects hereof are described with respect to transitioning between running and cycling, in additional exemplary aspects, the stability element may be customized for any number of athletic activities. For example, a stability element might be customized to include cleats for indoor soccer, outdoor soccer, lacrosse, golf, football, and any number of other activities requiring particular footwear. In this way, exemplary aspects hereof may enable a wearer to transition among any number of athletic activities without having to acquire multiple different items of footwear. Instead, a wearer may acquire various stability elements that are customized for various athletic activities, and then simply change from one customized stability element to another in order to transition among activities.

The following exemplary aspects are provided to introduce a selection of concepts in a simplified form that are further described below. These aspects are not intended to identify key features or essential features of the claimed subject matter, nor are they intended to be used as an aid in determining the scope of the claimed subject matter.

Exemplary aspects hereof include an article of footwear having a sole and a stability element. The sole may have a receiving channel extending from a sole bottom surface toward a sole top surface. The receiving channel may have a first groove at an outer perimeter of the receiving channel and a second groove at an inner perimeter of the receiving channel. The stability element may include a first tongue protruding from an outer perimeter of a body of the stability element and a second tongue protruding from an inner perimeter of the body of the stability element. In an exemplary aspect, the first groove of the receiving channel is configured to receive the first tongue of the stability element, and the second groove of the receiving channel is configured to receive the second tongue of the stability element as the stability element is maintained, at least in part, within the receiving channel. As such, a compression fit between the tongues of the stability element and the grooves of the receiving channel may securely hold the stability element within the sole of the shoe.

Additionally, the first groove may include a first groove bottom surface, a first groove recessed surface, and a first groove top surface. The first groove recessed surface may be recessed from the receiving channel outer perimeter by a first groove width. In particular, the first groove recessed surface may be recessed from the receiving channel outer perimeter between an upper portion of the receiving channel outer perimeter and a lower portion of the receiving channel outer perimeter. The upper portion of the receiving channel outer perimeter may be proximate to a top surface of the receiving channel, and the lower portion of the receiving channel outer perimeter may be proximate to the bottom surface of the sole.

Similarly, the second groove may include a second groove bottom surface, a second groove recessed surface, and a second groove top surface. The second groove recessed surface may be recessed from the receiving channel inner perimeter by a second groove width. In particular, the second groove recessed surface may be recessed from the receiving channel inner perimeter between an upper portion of the receiving channel inner perimeter and a lower portion of the receiving channel inner perimeter. The upper portion of the receiving channel inner perimeter may be proximate to the top surface of the receiving channel, and the lower portion of the receiving channel inner perimeter may be proximate to the bottom surface of the sole.

Regarding the first and second tongues, the first tongue may include a first tongue bottom surface, a first tongue protruded surface, and a first tongue top surface. The first tongue protruded surface may protrude from the outer perimeter of the stability element body by a first tongue width. In particular, the first tongue protruded surface may protrude from the outer perimeter of the stability element body between an upper portion of the stability element body outer perimeter and a lower portion of the stability element body outer perimeter. Similarly, the second tongue may include a second tongue bottom surface, a second tongue protruded surface, and a second tongue top surface. The second tongue protruded surface may protrude from the inner perimeter of the stability element body by a second tongue width. In particular, the second tongue protruded surface may protrude from the inner perimeter of the stability element body between an upper portion of the stability element body inner perimeter and a lower portion of the stability element body inner perimeter.

Accordingly, the first groove may be associated with a first groove width and a first groove height; the second groove may be associated with a second groove width and a second groove height; the first tongue may be associated with a first tongue width and a first tongue height; and the second tongue may be associated with a second tongue width and a second tongue height. In one example, the first groove width is greater than the first tongue width. In another example, the first groove height is equal to or less than the first tongue height to effectively apply a compressive force on the first tongue when maintained. In yet another example, the first groove width is greater than the first tongue width and the first groove height is equal to or less than the first tongue height. Similarly, the second groove width may be greater than the second tongue width. The second groove height may be equal to or less than the second tongue height. In one example, the second groove width is greater than the second tongue width and the second groove height is equal to or less than the second tongue height. Each of the combinations of relative size of width and/or height may be adjusted to achieve a releasable mating interaction between the tongue and groove elements. For example, if the material forming the groove elements is more compliant/compressible than the material forming the tongue elements, a groove height that is less than or equal to the tongue height may leverage an expansive characteristic of the groove to expand around the tongue when mated to provide a compressive maintaining of the tongue element, in an exemplary aspect.

Additional aspects hereof provide an article of footwear including a sole and an elongated stability element. The sole may include a toe end positioned opposite of a heel end, a bottom surface, and an elongated receiving channel extending into the sole from the bottom surface. The elongated receiving channel may include a toe end portion disposed at the sole toe end, a heel end portion disposed at the sole heel end, an outer edge including a first groove, and an inner edge including a second groove. The elongated stability element may include a stability element body having a stability element toe end portion and a stability element heel end portion. The elongated stability element may further include a first tongue protruding from an outer peripheral surface of the stability element body and a second tongue protruding from an inner peripheral surface of the stability element body. In an exemplary aspect, the elongated receiving channel is configured to receive the stability element body such that the stability element toe end portion is disposed at the receiving channel toe end portion and the stability element heel end portion is disposed at the receiving channel heel end portion. Additionally, the first groove of the receiving channel outer edge may be configured to receive the first tongue protruding from the outer peripheral surface of the stability element body, and the second groove of the receiving channel inner edge may be configured to receive the second tongue protruding from the inner peripheral surface of the stability element body. In one example, the elongated receiving channel receives the stability element body from the bottom surface of the sole inward, toward a top surface of the sole.

In further aspects, an article of footwear including a sole and a stability element is provided. The sole may have a top surface and an opposite bottom surface, a heel end and an opposite toe end, and a medial side and an opposite lateral side. A receiving channel may extend into the sole from the bottom surface, between the toe end and the heel end of the sole, and also between the medial side and the lateral side of the sole. The receiving channel may include a body portion and an outer perimeter groove, where the outer perimeter groove extends closer to the sole lateral side and the sole medial side than the body portion extends to the sole lateral side and the sole medial side. Regarding the stability element, it may have a body with a toe end and an opposite heel end, a medial side and an opposite lateral side, and a top surface and an opposite bottom surface. The stability element may further include a clip receiving portion that extends from the body of the stability element, between the toe end and heel end, at the bottom surface of the stability element body. Additionally, an outer tongue protruding from an outer peripheral surface of the stability element body may be included between the top surface and the bottom surface of the stability element body. The outer tongue may be configured to be received in the outer perimeter groove of the receiving channel when the stability element is coupled with the sole at the receiving channel.

In one example, the sole is made of a deformable material and the stability element is made of a substantially rigid material. As such, when the substantially rigid stability element exerts a force on the deformable sole, such as when the stability element is coupled with the sole, the stability element may cause portions of the sole to become deformed. For example, portions of the sole may compress and/or stretch to accommodate the stability element, and consequently, a compression fit between the sole and the stability element may securely hold the stability element within the sole of the shoe.

In further examples, a difference between a distance by which the outer perimeter groove extends to the sole lateral side and the sole medial side and a distance by which the body portion of the receiving channel extends to the sole lateral side and the sole medial side may correspond to an outer perimeter groove width. A distance by which the outer tongue protrudes from the outer peripheral surface of the stability element body may correspond to an outer tongue width. In one example, the outer tongue width is less than the outer perimeter groove width.

Additionally, a height from a top of the outer perimeter groove to a top surface of the receiving channel may be substantially equal to a height from a top of the outer tongue to the top surface of the stability element body. The height from the sole bottom surface to a bottom of the outer perimeter groove may be substantially equal to a height from the stability element body bottom surface to a bottom of the outer tongue. In one example, the height from the top of the outer perimeter groove to the top surface of the receiving channel is substantially equal to the height from the top of the outer tongue to the top surface of the stability element body, and the height from the sole bottom surface to the bottom of the outer perimeter groove is substantially equal to the height from the stability element body bottom surface to the bottom of the outer tongue.

The clip receiving portion of the stability element may extend laterally away from the stability element body, as well as vertically away from the stability element body bottom surface. When the stability element body is coupled with the sole at the receiving channel, the clip receiving portion may extend vertically away from the sole bottom surface. In one example, when the stability element body is coupled with the sole at the receiving channel, a distance between the sole bottom surface and the clip receiving portion is at least a minimum threshold distance.

In another example, the receiving channel further includes an inner perimeter groove. The inner perimeter groove may extend closer to the sole lateral side and the sole medial side than the body portion of the receiving channel extends to the sole lateral side and the sole medial side. Furthermore, the stability element may include an inner tongue protruding from an inner peripheral surface of the stability element body between the top surface and the bottom surface of the stability element body.

Referring now to FIG. 1, an exemplary article of footwear ("shoe") 100 is depicted. Conventional articles of athletic footwear have included two primary elements, namely an upper member ("upper") 103 and a sole structure ("sole") 102. The upper 103 may provide a covering for the foot that securely receives and positions the foot with respect to the sole 102. In addition, the upper 103 may have a configuration that protects the foot and provides ventilation, thereby cooling the foot and removing perspiration. The sole 102 may be secured to a lower portion of the upper 103 and generally is positioned between the foot and the ground. In addition to attenuating ground or other contact surface reaction forces, the sole 102 may provide traction and control foot motions, such as pronation. Accordingly, the upper 103 and sole 102 operate cooperatively to provide a comfortable structure that is suited for a variety of ambulatory activities, such as walking and running.

While the exemplary sole 102 and upper 103 are presented in a simplified fashion, in practice, an upper may comprise a large number of individual parts, often formed from different types of materials. Additionally or alternatively, an upper may be primarily formed from a single manufacturing technique, such as weaving or knitting, to concurrently and integrally form two or more portions of the upper. The components of an upper may be joined together using a variety of adhesives, stitches, and other types of joining/bonding components. Similarly, a sole may include multiple components. For example, a sole may include an outsole made of a relatively hard and durable material, such as rubber, that contacts the ground, floor, or other surface. The sole may further include a midsole formed from a material that provides cushioning and absorbs/attenuates force during normal wear and/or athletic training or performance. For example, the midsole might be formed of foam, plastic, and/or rubber. Examples of materials often used in midsoles are, for example, ethylene vinyl acetate foams, polyurethane foams, and the like. The sole may further have additional components, such as additional cushioning components (such as springs, air bags, and the like), functional components (such as motion control elements to address pronation or supination), protective elements (such as resilient plates to prevent damage to the foot from hazards on the floor or ground), and the like. In a further exemplary aspect, the outsole and midsole may be constructed of the same, or similar, material, such that the outsole and midsole form a substantially continuous component. While these and other components that may be present in an upper and/or a sole are not specifically described in examples herein, such components may be present in shoes in accordance with aspects hereof.

As shown in FIG. 1, a receiving channel 116 may be included at the sole 102. The receiving channel 116 and other exemplary aspects of the sole 102 are illustrated in the bottom-up view of the sole 102 in FIG. 2 and the cross-section view of the sole 102 in FIG. 3. In particular, the exemplary sole 102 has a top surface 104 and an opposite bottom surface 106. The sole 102 further has a toe end 108 and opposite heel end 110, as well as a medial side 112 and opposite lateral side 114. The toe end 108 and the heel end 110 may be axially opposed along a longitudinal axis 168, and the medial side 112 and the lateral side 114 may be axially opposed along a lateral axis 170, which is substantially orthogonal to the longitudinal axis 168.

Figure 3:
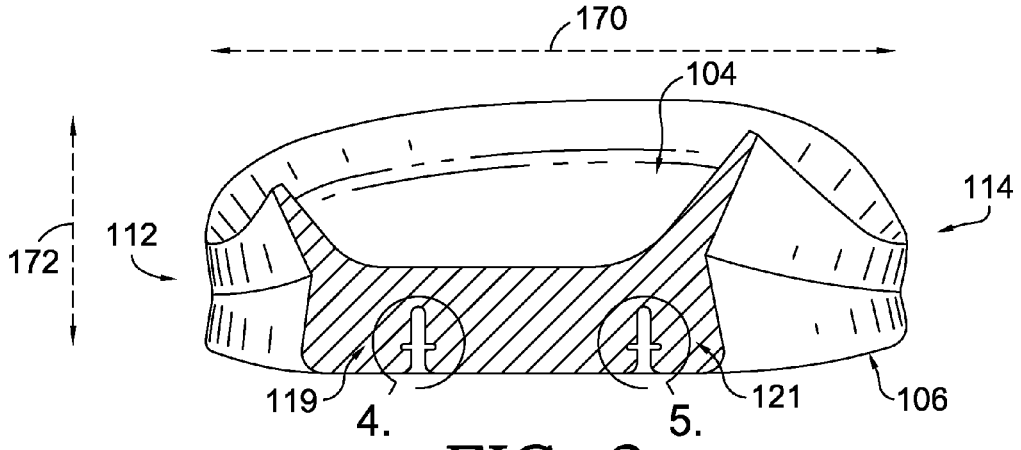
FIG. 3 depicts a cross-section view of the sole of FIG. 2, in accordance with an exemplary aspect hereof.

In an exemplary aspect, the receiving channel 116 extends into the sole 102 from the bottom surface 106 toward the top surface 104. This is illustrated in FIG. 3, and will be discussed in more detail with respect to FIGS. 4-5. The receiving channel 116 may extend between the sole toe end 108 and the sole heel end 110, and between the sole medial side 112 and the sole lateral side 114. In particular, a toe-end portion 118 of the receiving channel 116 may be disposed at the sole toe end 108; a heel-end portion 120 of the receiving channel 116 may be disposed at the sole heel end 110; a medial-side portion 119 of the receiving channel 116 may be disposed at the sole medial side 112; and a lateral-side portion 121 of the receiving channel 116 may be disposed at the sole lateral side 114.

Figure 2:
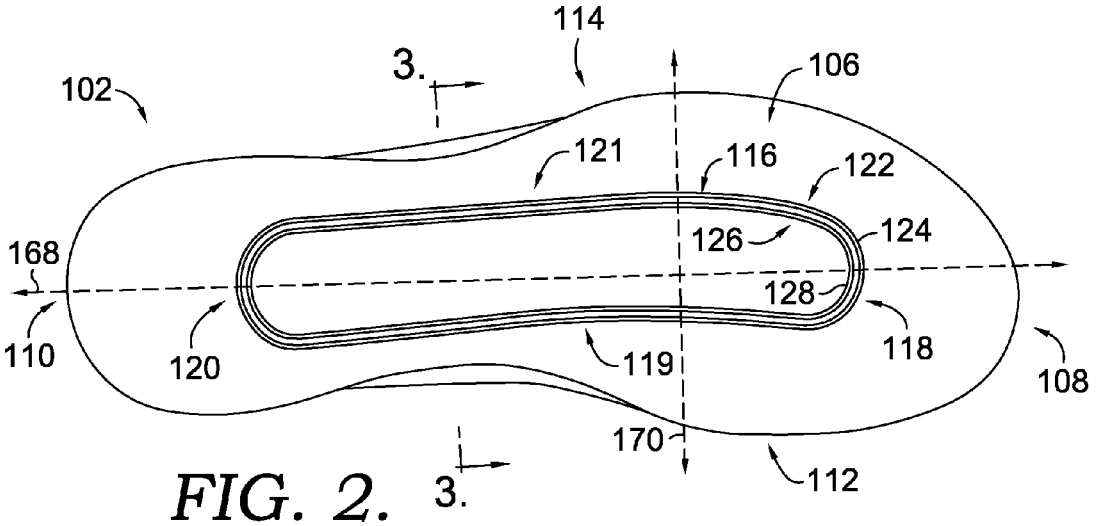
FIG. 2 depicts a bottom-up view of the sole of the article of footwear of FIG. 1, in accordance with an exemplary aspect hereof.

In an exemplary aspect, the receiving channel 116 is characterized by an elongated configuration, such as an oblong shape, when viewed from the bottom up, as in FIG. 2. It should be noted, however, that the shape of the receiving channel 116 is not limited to the shape depicted in the figures. In exemplary aspects, a shape of the receiving channel 116 may include an oval, ellipse, rectangle, figure eight, or any other regular or irregular geometric shape. A perimeter of the shape may be characterized by linear lines, non-linear curves, or a combination of the two (e.g., a shape having straight edges, curved edges, or a combination of the two). Any and all such configurations are included within the scope hereof. Additionally, in exemplary aspects, the receiving channel 116 is characterized by a configuration other than an elongated configuration. For example, in some aspects, the receiving channel 116 does not extend from the sole toe end 108 to the sole heel end 110, but instead, the entire receiving channel 116 may be disposed at the sole toe end 108. Additionally or alternatively, the entire receiving channel 116 may be disposed at the sole heel end 110. Furthermore, the receiving channel 116 need not be one continuous geometric shape, but might instead comprise multiple, separate geometric shapes (e.g., an oval at the sole toe end 108 and a separate oval at the sole heel end 110). Other configurations are also contemplated as being included within the scope hereof. In some instances, the receiving channel 116 might also function as a flex groove. For example, the sole 102 might include a network of flex grooves (e.g., a grid of flex grooves) that allows the sole 102 to flex. At least a portion of these same flex grooves might also serve as the receiving channel 116, in some instances.

The exemplary receiving channel 116 may further include an outer edge 124 disposed at an outer perimeter 122 of the receiving channel 116, as well as an inner edge 128 disposed at an inner perimeter 126 of the receiving channel 116. Again, this depiction is exemplary only. In other exemplary aspects, the receiving channel 116 may include only the outer edge 124 disposed at the outer perimeter 122. For example, if the receiving channel 116 resembles a solid shape (e.g., a solid oval recessed into the sole of the shoe, as opposed to an outline of an oval having a void interior), the receiving channel 116 may have only outer edges around the outer perimeter of the shape.

Figure 4:
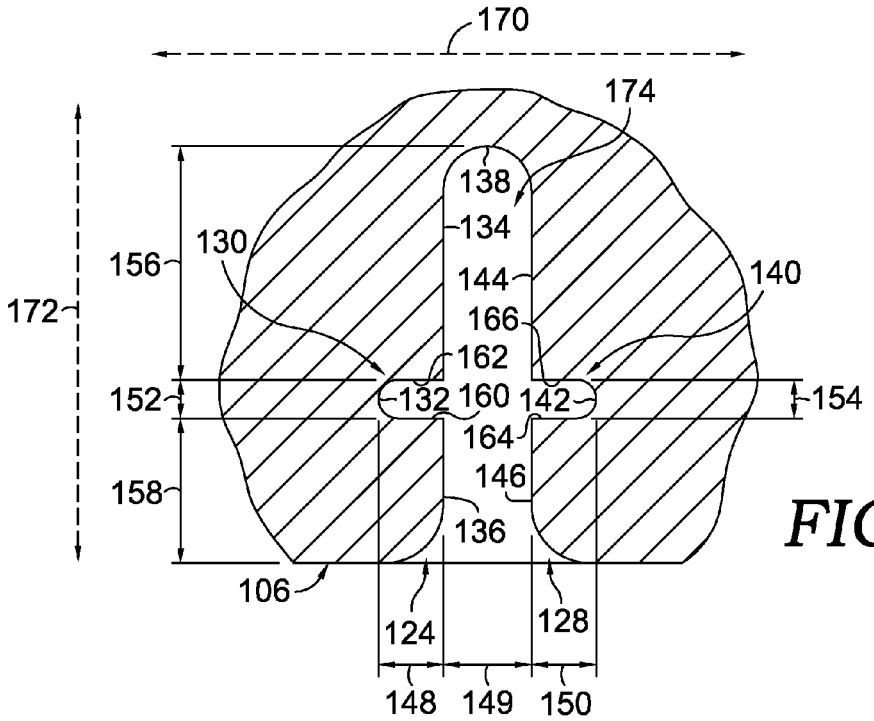
FIG. 4 depicts an enlarged view of a portion of the cross-section of FIG. 3, in accordance with an exemplary aspect hereof.
Figure 5:
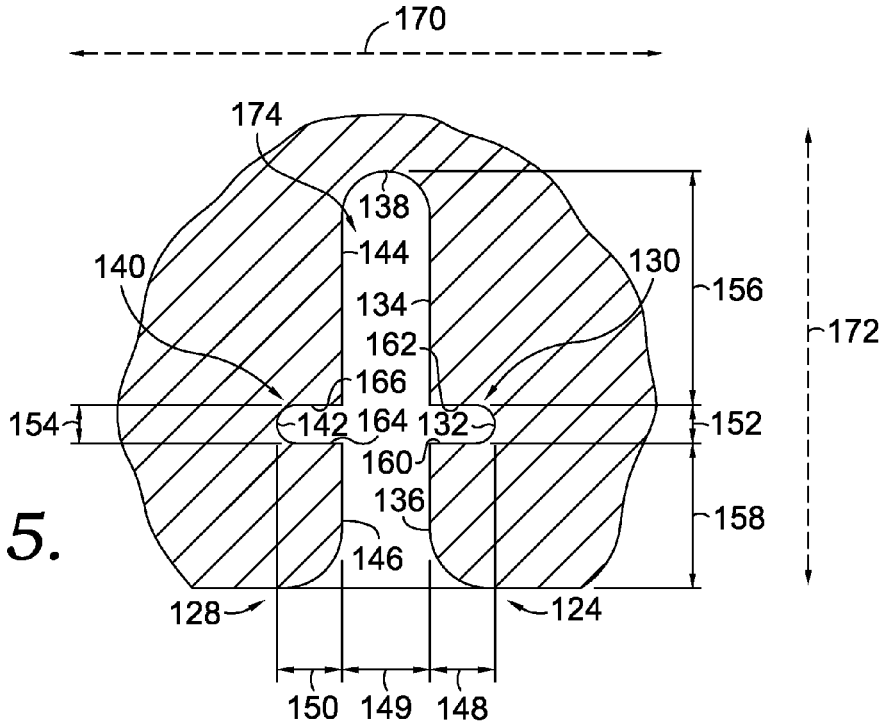
FIG. 5 depicts an enlarged view of a portion of the cross-section of FIG. 3, in accordance with an exemplary aspect hereof.

The receiving channel 116 may include a body portion and one or more grooves at the inner and/or outer edges. These aspects of the receiving channel 116 are illustrated in the cross-section view of FIG. 3 and the corresponding enlarged views provided in FIGS. 4-5. Specifically, FIG. 4 provides an enlarged, cross-section view of the receiving channel 116 at the medial-side portion 119, and FIG. 5 provides an enlarged, cross-section view of the receiving channel 116 at the lateral-side portion 121. As depicted in FIGS. 4-5, the receiving channel 116 may include a body portion 174, an outer groove 130 at the outer edge 124 of the receiving channel 116, and an inner groove 140 at the inner edge 128 of the receiving channel 116. The body portion 174 may be bounded by a top surface 138 of the receiving channel 116, the outer edge 124, the inner edge 128, and a plane corresponding to the bottom surface 106 of the sole 102. This depiction is exemplary only and should not be construed as limiting. In other aspects, only one groove may be included at the receiving channel 116. Any and all such combinations are contemplated as being within the scope hereof.

In an exemplary aspect, the outer groove 130 may be characterized by a bottom surface 160, a recessed surface 132, and a top surface 162. The outer groove 130 may be positioned between an upper portion 134 of the outer edge 124 and a lower portion 136 of the outer edge 124. The lower portion 136 may be proximate to the sole bottom surface 106, and the upper portion 134 may be proximate to the top surface 138 of the receiving channel 116. As used herein, the term "proximate" is intended to mean on, about, near, by, next to, at, and the like. Therefore, when a feature is proximate another feature, it may be in close in proximity to, but not necessarily exactly at, the described location, in some aspects.

As illustrated in FIGS. 4-5, the recessed surface 132 may extend closer to the sole medial side 112 and the sole lateral side 114 along the lateral axis 170 than the outer edge 124 extends to the sole medial side 112 and the sole lateral side 114 along the lateral axis 170. This feature might also be described as the outer groove 130 extending closer to the sole medial side 112 and the sole lateral side 114 than the body portion 174 extends to the sole medial side 112 and the sole lateral side 114. A width 148 of the outer groove 130 may be measured from the outer edge 124 to the recessed surface 132 along the lateral axis 170. A height 152 of the outer groove 130 may be measured from the bottom 160 of the outer groove 130 to the top 162 of the outer groove 130 in the direction of a vertical axis 172. This height 152 might also be described as a height of the recessed surface 132.

Similarly, the inner groove 140 may be characterized by a bottom surface 164, a recessed surface 142, and a top surface 166. The inner groove 140 may be positioned between an upper portion 144 of the inner edge 128 and a lower portion 146 of the inner edge 128, where the upper portion 144 may be proximate to the top surface 138 of the receiving channel 116 and the lower portion 146 may be proximate to the sole bottom surface 106. Analogous to the recessed surface 132 of the outer groove 130, the recessed surface 142 of the inner groove 140 may extend closer to the sole medial side 112 and the sole lateral side 114 along the lateral axis 170 than the inner edge 128 extends to the sole medial side 112 and the sole lateral side 114 along the lateral axis 170. This feature might also be described as the inner groove 140 extending closer to the sole medial side 112 and the sole lateral side 114 than the body portion 174 extends to the sole medial side 112 and the sole lateral side 114. A width 150 of the inner groove 140 may be measured from the inner edge 128 to the recessed surface 142 along the lateral axis 170. A height 154 of the inner groove 140 may be measured from the bottom 164 of the inner groove 140 to the top 166 of the inner groove 140 in the direction of the vertical axis 172. This height 154 might also be described as a height of the recessed surface 142.

As illustrated, both the outer groove 130 and the inner groove 140 may extend beyond the width 149 of the body portion 174 of the receiving channel 116, in the direction of the lateral axis 170. The width 149 of the body portion 174 of the receiving channel 116 may be measured as the distance between the outer edge 124 and the inner edge 128.

In an exemplary aspect, the width 148 of the outer groove 130 is substantially equal to the width 150 of the inner groove 140. As used herein, the terms "substantially" and "approximately," when used to describe a relative distance, include a range of 95% to 105% of the specified distance. For example, according to statement above, a numerical value corresponding to the outer groove width 148 may be between 95% and 105% of the value corresponding to the inner groove width 150. In further aspects the width 148 is different from the width 150. Similarly, in an exemplary aspect, the height 152 of the outer groove 130 is substantially equal to the height 154 of the inner groove 140, while in further aspects, the height 152 is different from the height 154. Thus, the cross-section shape of the receiving channel 116 may be symmetrical or asymmetrical, in exemplary aspects.

The total distance by which the body portion 174 of the receiving channel 116 extends into the bottom surface 106 of the sole 102 may be defined as a sum of the vertical distance 158 between the sole bottom surface 106 and the outer groove bottom 160, the groove height 152, and the vertical distance 156 between the outer groove top 162 and the top surface 138 of the receiving channel 116. Note that these distances might also be defined with respect to the analogous portions of the inner groove 140, and that such distances with respect to the inner groove 140 may be substantially the same as, or different from, the distances defined with respect to the outer groove 130. Thus, as already mentioned, the cross-section shape of the receiving channel 116 may be symmetrical or asymmetrical, in exemplary aspects.

The term "cross-section shape," as used herein with respect to the receiving channel 116, may refer to the position, orientation, size, configuration, as well as any number of other aspects associated with the cross-section view of the receiving channel 116. Note that the cross-section shape is separate from the shape of the receiving channel 116 when viewed from the bottom up, as discussed with respect to FIG. 2. The cross-section shape of the medial-side portion 119 of the receiving channel 116, depicted in FIG. 4, may be substantially similar to the cross-section shape of the lateral-side portion 121 of the receiving channel 116, depicted in FIG. 5. By way of example, the heights and widths of the outer groove 130 and the inner groove 140 at the medial-side portion 119 of the receiving channel 116 (FIG. 4) may be substantially equal to the heights and widths of the outer groove 130 and the inner groove 140 at the lateral-side portion 121 of the receiving channel 116 (FIG. 5). To this point, the similar sizing proportionality between lateral-side segments and corresponding medial-side segments formed by a common plane perpendicularly intersecting the longitudinal axis 168 may be true at any location along the longitudinal axis 168. In other words, the receiving channel 116 may be substantially symmetric about the longitudinal axis 168.

In further exemplary aspects, the cross-section shape of the medial-side portion 119 of the receiving channel 116 may be different from the cross-section shape of the lateral-side portion 121 of the receiving channel 116. By way of example only, a width of the inner groove 140 at the medial-side portion 119 of the receiving channel 116 may be greater than a width of the inner groove 140 at the lateral-side portion 121 of the receiving channel 116. As can be imagined, any other number of variations between the cross-section shape of the medial-side portion 119 of the receiving channel 116 and the lateral-side portion 121 of the receiving channel 116 may exist. In other words, the receiving channel 116 may be substantially asymmetric about the longitudinal axis 168.

In additional exemplary aspects, the cross-section shape of the receiving channel 116 may vary along the longitudinal axis 168. Thus, a cross-section of the receiving channel 116 taken in the direction of the lateral axis 170 near the toe-end portion 118 of the receiving channel 116 may have a different shape compared to a cross-section taken in the same direction near the heel-end portion 120 of the receiving channel 116. By way of example only, the total distance by which the receiving channel 116 extends into the bottom surface 106 of the sole 102 may decrease along the length of the receiving channel 116, with a greater distance associated with the heel-end portion 120 and a smaller distance associated with the toe-end portion 118. For example, the distance 156 from the top 162 of the outer groove 130 to the top surface 138 of the receiving channel 116 may be greater at the heel-end portion 120 than at the toe-end portion 118.

Figure 6:
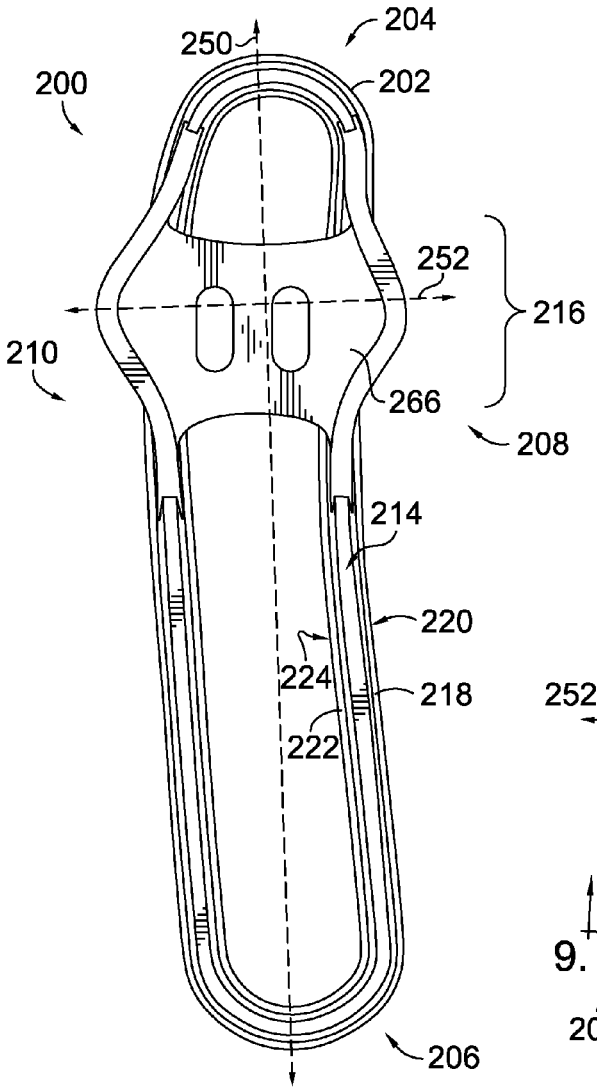
FIG. 6 depicts a bottom-up view of a stability element, in accordance with an exemplary aspect hereof.
Figure 7:
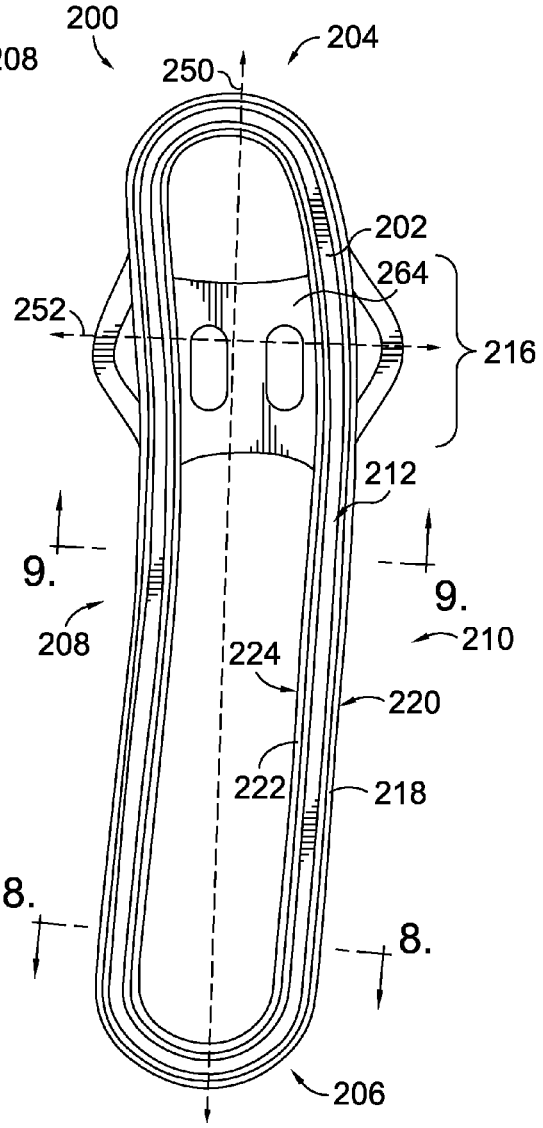
FIG. 7 depicts a top-down view of the stability element of FIG. 6, in accordance with an exemplary aspect hereof.

As has been mentioned, the receiving channel 116 may be configured to receive a stability element. Exemplary aspects of the stability element 200 are discussed below with respect to FIGS. 6-9. Beginning with FIG. 6 and FIG. 7, a bottom-up view and a top-down view, respectively, of the stability element 200 are provided. The exemplary stability element 200 has a body 202, which has a top surface 212 and an opposite bottom surface 214. The stability element 200 may further include a toe end 204 and an opposite heel end 206, as well as a medial side 208 and an opposite lateral side 210. In particular, the toe end 204 and heel end 206 may be axially opposed along the longitudinal axis 250, and the medial side 208 and lateral side 210 may be axially opposed along the lateral axis 252.

As used herein, the stability element body 202 refers to the depicted elongated portion of the stability element 200, which is discussed separately from the clip receiving portion 216 of the stability element 200. The clip receiving portion 216 may enable a wearer of the shoe 100 to engage clipless pedals when the stability element 200 is coupled with the sole 102 of the shoe 100. In an exemplary aspect, the clip receiving portion 216 extends laterally, in the direction of the lateral axis 252, away from the stability element body 202. The clip receiving portion 216 may also extend vertically, in a direction orthogonal to both the axis 250 and the axis 252 (see vertical axis 254 in FIGS. 8-9), away from the bottom surface 214 of the stability element body 202, between the toe end 204 and heel end 206 of the stability element 200. This vertical extension will be discussed in greater detail below. The exemplary clip receiving portion 216 has a top surface 264 and a bottom surface 266.

In an exemplary aspect, the stability element body 202 has a shape that is substantially similar to the shape of the receiving channel 116. As such, the stability element body 202 may be characterized by an elongated configuration, such as an oblong shape, when viewed from the top down, as in FIG. 7. The shape of the stability element body 202 when viewed from the top down may further include an oval, ellipse, rectangle, figure eight, or any other regular or irregular geometric shape. A perimeter of the shape may be characterized by linear lines, non-linear curves, or a combination of the two (e.g., a shape having straight edges, curved edges, or a combination of the two). Any and all such configurations are included within the scope hereof. Additionally, in exemplary aspects, the stability element body 202 is characterized by a configuration other than an elongated configuration. Such a stability element body 202 may be compatible with a particular configuration of the receiving channel 116, such as exemplary instances in which the entire receiving channel 116 may be disposed at the sole toe end 108 or at the sole heel end 110. Other configurations are also contemplated as being included within the scope hereof. Furthermore, as mentioned above with respect to the receiving channel 116, if the receiving channel 116 is comprised of at least a portion of a network of flex grooves, the stability element body 202 may be configured to fit within the desired portion of the network of flex grooves.

The exemplary stability element body 202 further includes an outer peripheral surface 220 (e.g., a surface at an outer perimeter of the stability element body 202) and an inner peripheral surface 224 (e.g., a surface at an inner perimeter of the stability element body 202). This depiction is exemplary only. In other exemplary aspects, the stability element body 202 may have only an outer peripheral surface (i.e., the absence of an inner peripheral surface as a result of the stability element body 202 being a solid volumetric form lacking an internal aperture/void). For example, if the stability element 200 resembles a solid volumetric form (e.g., a solid oval, as compared to an oval having a void interior extending through the oval, a rectangular prism, a cuboid), the stability element body 202 may have only an outer peripheral surface.

The stability element 200 may include tongues at the outer and/or inner peripheral surfaces of the stability element body 202. In particular, an outer tongue 218 may protrude from the outer peripheral surface 220 and the inner tongue 222 may protrude from the inner peripheral surface 224. This depiction is exemplary only and should not be construed as limiting. In other aspects, only one tongue may be included at the stability element body 202. Any and all such combinations are contemplated as being within the scope hereof.

Figure 8:
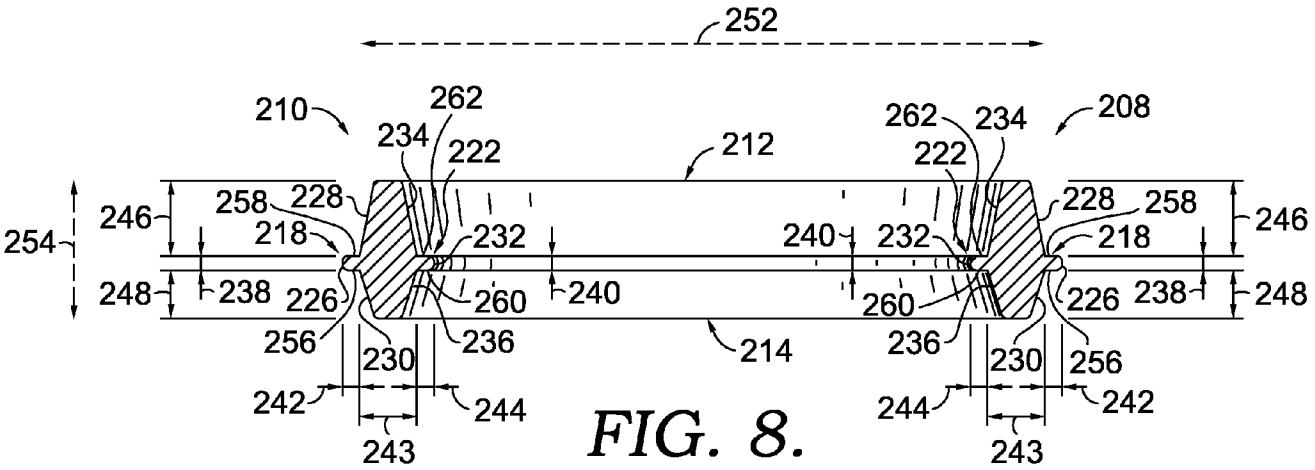
FIG. 8 depicts a cross-section view of the stability element of FIG. 7, where the cross-section view is in the direction of a heel end of the stability element, in accordance with an exemplary aspect hereof.

Exemplary aspects of the outer tongue 218 and inner tongue 222 are illustrated in the cross-section view of the stability element 200 in FIG. 8. The tongues 218 and 222 may protrude from the stability element body 202, between its top surface 212 and its bottom surface 214. For example, the outer tongue 218 may be characterized by a bottom surface 256, a protruded surface 226, and a top surface 258. The outer tongue may be positioned between an upper portion 228 of the outer peripheral surface 220 and a lower portion 230 of the outer peripheral surface, where the upper portion 228 is proximate to the top surface 212 of the stability element body 202 and the lower portion 230 is proximate to the bottom surface 214 of the stability element body 202. As illustrated, the protruded surface 226 may extend farther along the lateral axis 252 than either the lower portion 230 or the upper portion 228 of the outer peripheral surface 220 extends in the same direction. A width 242 of the outer tongue 218 may be measured from the lower portion 230 of the outer peripheral surface 220 to the protruded surface 226 in the direction of the lateral axis 252. This width 242 might also be described as the distance by which the outer tongue 218 protrudes from the outer peripheral surface 220. A height 238 of the outer tongue 218 may be measured, in the direction of the vertical axis 254, from the bottom 256 of the outer tongue 218 to the top 258 of the outer tongue 218. This height 238 might also be described as a height of the protruded surface 226.

Similarly, the inner tongue 222 may be characterized by a bottom surface 260, a protruded surface 232, and a top surface 262. The inner tongue 222 may be positioned between an upper portion 234 and a lower portion 236 of the inner peripheral surface 224, where the upper portion 234 is proximate to the top surface 212 of the stability element body 202 and the lower portion 236 is proximate to the bottom surface 214 of the stability element body 202. Analogous to the protruded surface 226 of the outer tongue 218, the protruded surface 232 of the inner tongue 222 may extend farther along the lateral axis 252 than either the lower portion 236 or the upper portion 234 of the inner peripheral surface 224 extends in the same direction. A width 244 of the inner tongue 222 may be measured, along the lateral axis 252, from the lower portion 236 of the inner peripheral surface 224 to the protruded surface 232. This width 244 might also be described as the distance by which the inner tongue 222 protrudes from the inner peripheral surface 224. A height 240 of the inner tongue 222 may be measured, in the direction of the vertical axis 254, from the bottom 260 of the inner tongue 222 to the top 262 of the inner tongue 222. This height 240 might also be described as a height of the protruded surface 232.

As illustrated, both the outer tongue 218 and the inner tongue 222 may extend beyond the width 243 of the stability element body 202, in the direction of the lateral axis 252. The width 243 of the stability element body 202 may be measured from the outer peripheral surface 220 to the inner peripheral surface 224.

In an exemplary aspect, the width 242 of the outer tongue 218 is substantially equal to the width 244 of the inner tongue 222. In further aspects, the width 242 is different from the width 244. Similarly, in an exemplary aspect, the height 238 of the outer tongue 218 is substantially equal to the height 240 of the inner tongue 222, while in further aspects, the height 238 is different from the height 240.

Thus, the cross-section shape of the stability element body 202 may be symmetrical or asymmetrical, in exemplary aspects.

The total height, in the direction of the vertical axis 254, of the stability element body 202 may be defined as a sum of the vertical distance 248 between the stability element body bottom surface 214 and the outer tongue bottom 256, the outer tongue height 238, and the vertical distance 246 between the outer tongue top 258 and the stability element body top surface 212. Note that these distances may also be defined with respect to the analogous portions the inner tongue 222, and that such distances with respect to the inner tongue 222 may be substantially the same as, or different from, the distances defined with respect to the outer tongue 218. Thus, as already mentioned, the cross-section shape of the stability element body 202 may be symmetrical or asymmetrical, in exemplary aspects.

The term "cross-section shape," as used herein with respect to the stability element body 202, may refer to the position, orientation, size, configuration, as well as any number of other aspects associated with the cross-section view of the stability element body 202. Note that the cross-section shape is separate from the shape of the stability element body 202 when viewed from the top down, as discussed with respect to FIG. 7. As illustrated in FIG. 8, the cross-section shape of the stability element body 202 at the medial side 208 of the stability element 200 may be substantially similar to the cross-section shape of the stability element body 202 at the lateral side 210 of the stability element 200. By way of example, the heights and widths of the outer tongue 218 and the inner tongue 222 at the medial side 208 of the stability element 200 may be substantially equal to the heights and widths of the outer tongue 218 and the inner tongue 222 at the lateral side 210 of the stability element 200. This may be true for any cross-section slice that is taken in the direction of the lateral axis 252 at any point along the longitudinal axis 250. In other words, the stability element body 202 may be substantially symmetric about the longitudinal axis 250.

In further exemplary aspects, the cross-section shape of the stability element body 202 at the medial side 208 may be different from the cross-section shape of the stability element body 202 at the lateral side 210. By way of example only, a width of the inner tongue 222 at the medial side 208 of the stability element 200 may be greater than a width of the inner tongue 222 at the lateral side 210 of the stability element 200. As can be imagined, any other number of variations between the cross-section shape of the stability element body 202 at the medial side 208 and at the lateral side 210 of the stability element 200 may exist. In other words, the stability element body 202 may be substantially asymmetric about the longitudinal axis 250.

Figure 9:
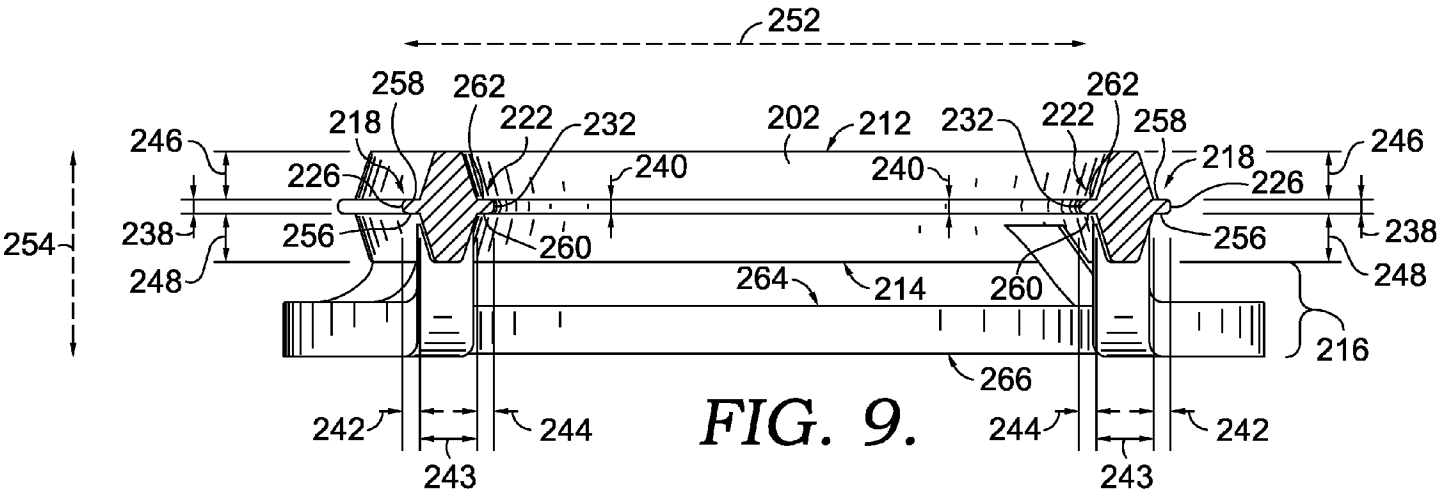
FIG. 9 depicts a cross-section view of the stability element of FIG. 7, where the cross-section view is in the direction of a toe end of the stability element, in accordance with an exemplary aspect hereof.

In additional exemplary aspects, the cross-section shape of the stability element body 202 may vary along the longitudinal axis 250. Thus, a cross-section of the stability element body 202 taken in the direction of the lateral axis 252 near the toe end 204 may have a different shape compared to a cross-section taken in the same direction near the heel end 206. This exemplary aspect is illustrated by a comparison of FIG. 8, which includes a cross-section taken near the heel end 206, with FIG. 9, which includes a cross-section taken closer to the toe end 204. As shown in this comparison, the total height of the stability element body 202 may decrease along the length of the stability element 200, with a greater height associated with a cross-section at the heel end 206 (FIG. 8) and a smaller height associated with a cross-section at the toe end 204 (FIG. 9). For example, the distance 246 from the top 258 of the outer tongue 218 to the top surface 212 of the stability element body 202 may be greater at the heel end 206 than at the toe end 204. In one exemplary aspect, at the heel end 206 (FIG. 8), the distance 246 from the outer tongue top 258 to the stability element body top surface 212 is greater than the distance 248 between the stability element body bottom surface 214 and the outer tongue bottom 256; while at the toe end 204 (FIG. 9), the distance 246 from the outer tongue top 258 to the stability element body top surface 212 is approximately the same as the distance 248 between the stability element body bottom surface 214 and the outer tongue bottom 256.

Also provided in FIG. 9 is a cross-section view of the stability element 200 that includes the clip receiving portion 216. As mentioned, the clip receiving portion extends both laterally, in the direction of the lateral axis 252, and vertically, in the direction of the vertical axis 254, away from the stability element body 202. In particular, FIG. 9 shows the clip receiving portion 216 extending vertically away from the stability element body bottom surface 214, such that the stability element body bottom surface is separated by a distance from the top surface 264 of the clip receiving portion 216. In one example, this distance is at least a threshold distance. The threshold may be between 0.5 and 5 centimeters. In another example, the distance is at least 2 centimeters.

Figure 10:
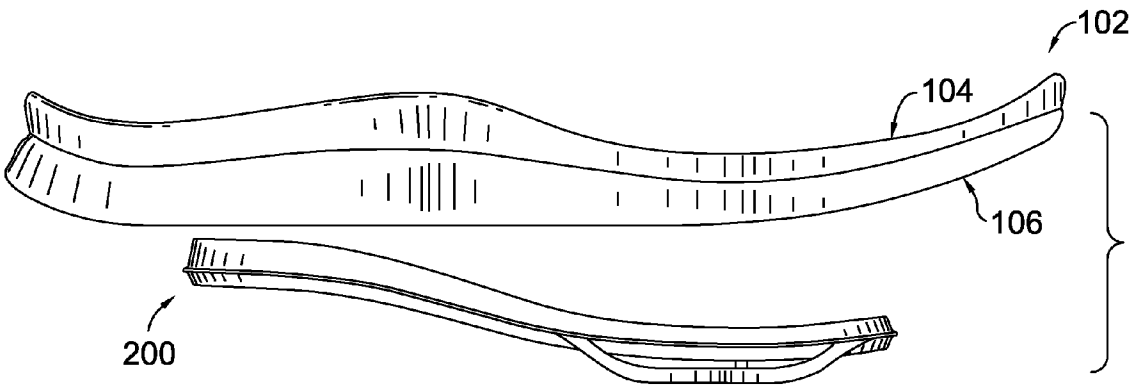
FIG. 10 depicts a side view of the sole of FIG. 2 and the stability element of FIG. 6, in accordance with an exemplary aspect hereof.
Figure 11:
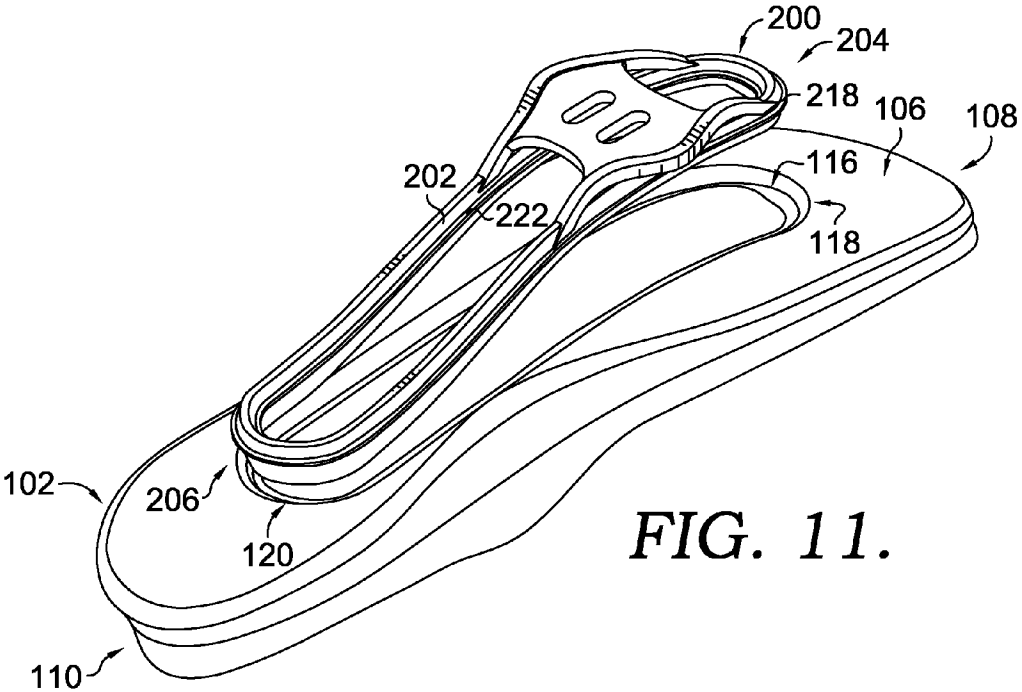
FIG. 11 depicts a perspective view of the sole of FIG. 2 and the stability element of FIG. 6, where the receiving channel of the sole receives the stability element from the bottom surface of the sole inward, toward a top surface of the sole, in accordance with an exemplary aspect hereof.
Figure 12:
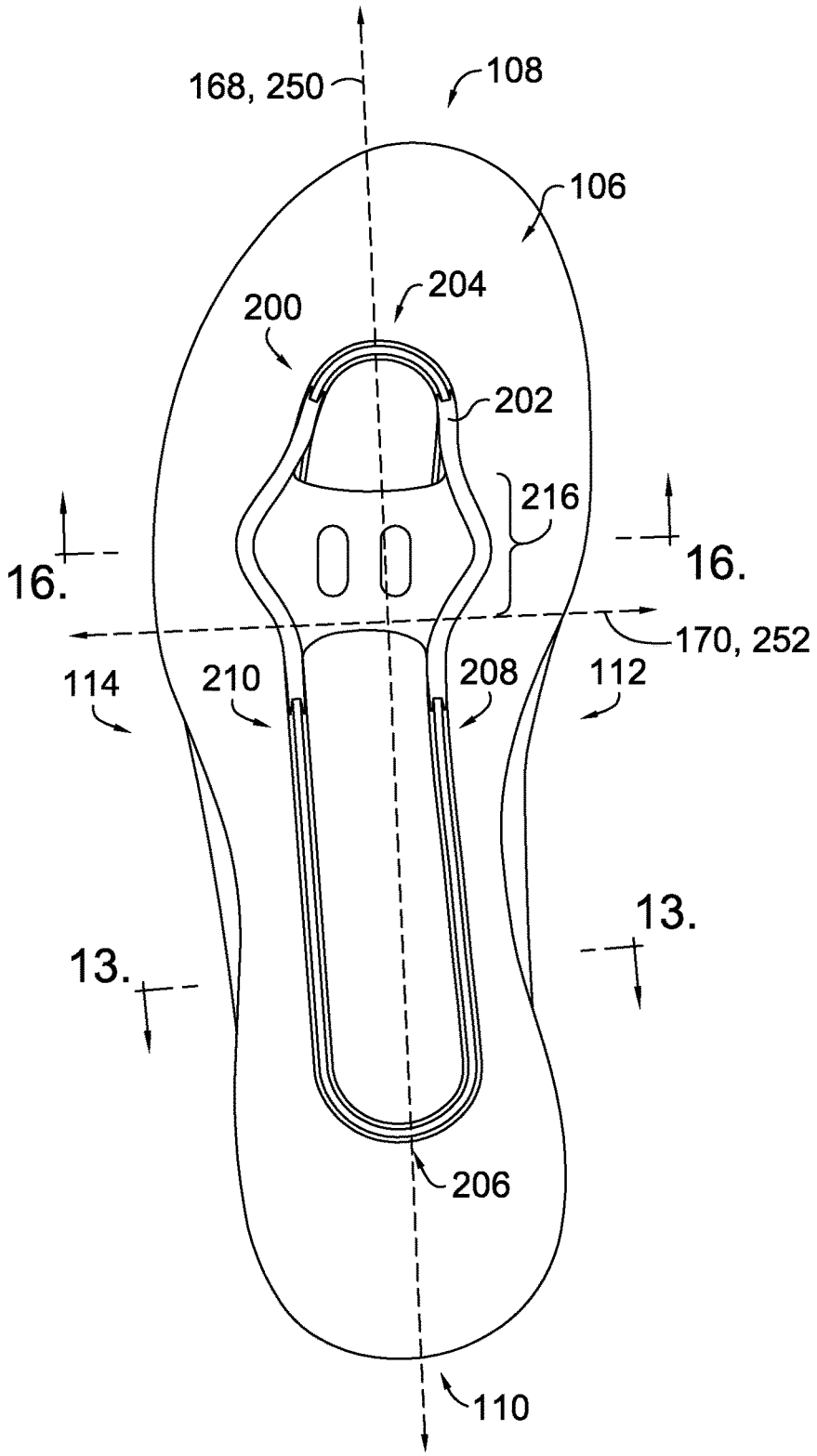
FIG. 12 depicts a bottom-up view of the sole of FIG. 2 coupled with the stability element of FIG. 6 at the receiving channel of the sole, in accordance with an exemplary aspect hereof.

Exemplary aspects of the interaction between the sole 102 of the shoe 100 and the stability element 200 will now be described with respect to the remaining figures. As shown in FIGS. 10-12, the receiving channel 116 may be configured to receive the stability element body 202 from the sole bottom surface 106 inward, toward the sole top surface 104, such that the stability element body 202 is disposed within the sole 102. In particular, the outer groove 130 of the receiving channel 116 may be configured to receive the outer tongue 218 of the stability element 200, such that the outer tongue 218 is securely coupled with the outer groove 130. Similarly, the inner groove 140 may be configured to receive the inner tongue 222, such that the inner tongue 222 is securely coupled with the inner groove 140. As shown in FIG. 12, when the stability element body 202 is coupled with the sole 102, the stability element toe end 204 may be disposed at the toe-end portion 118 (not shown) of the receiving channel 116 (not shown) and the stability element heel end 206 may be disposed at the heel-end portion 120 (not shown) of the receiving channel 116 (not shown). Similarly, the stability element medial side 208 may be disposed at the receiving channel medial-side portion 119 (not shown) and the stability element lateral side 210 may be disposed at the receiving channel lateral-side portion 121 (not shown).

Figure 13:
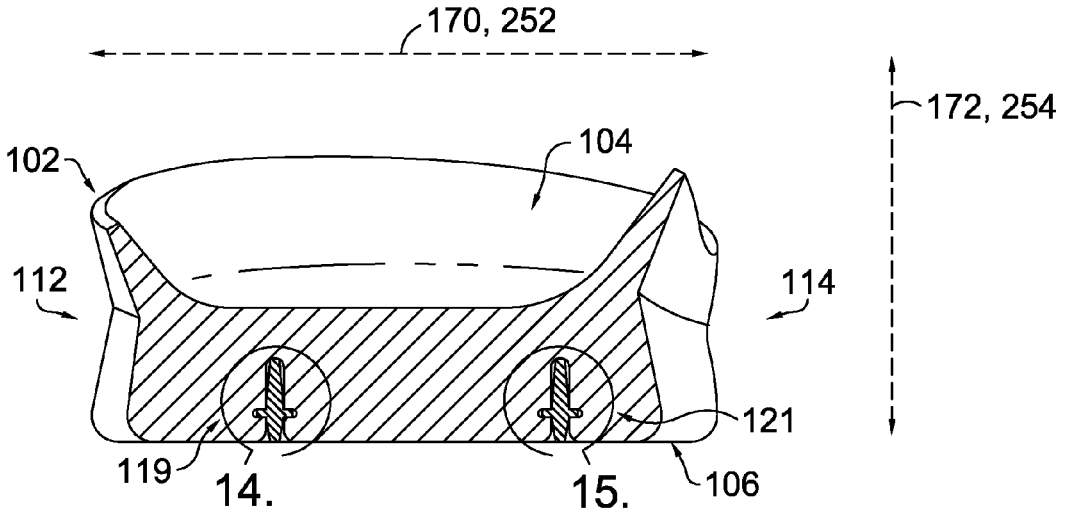
FIG. 13 depicts a cross-section view of the sole and stability element of FIG. 12, where the cross-section view is in the direction of the heel end of the sole and the heel end of the stability element, in accordance with an exemplary aspect hereof.
Figure 14:
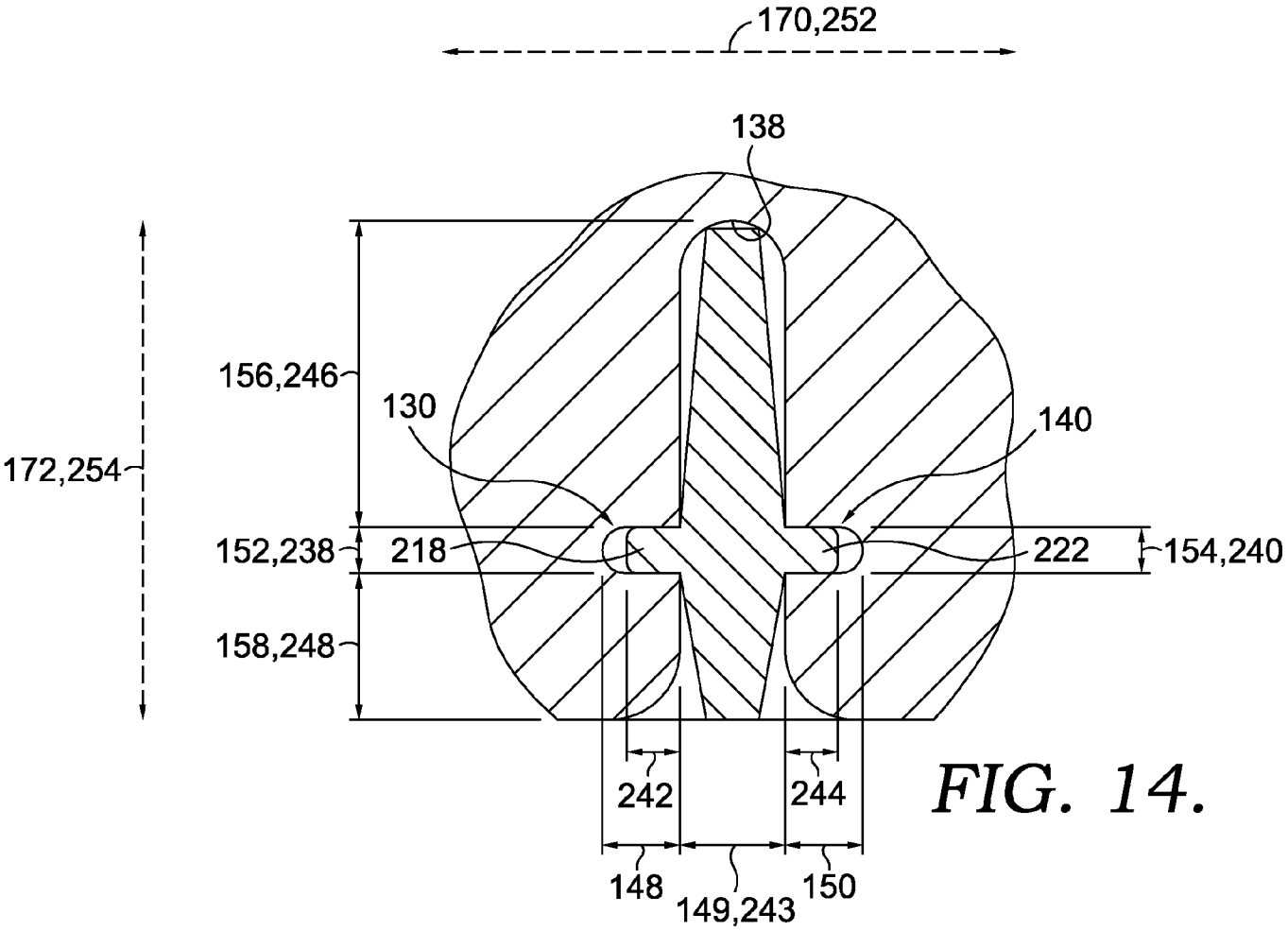
FIG. 14 depicts an enlarged view of a portion of the cross-section of FIG. 13, in accordance with an exemplary aspect hereof.
Figure 15:
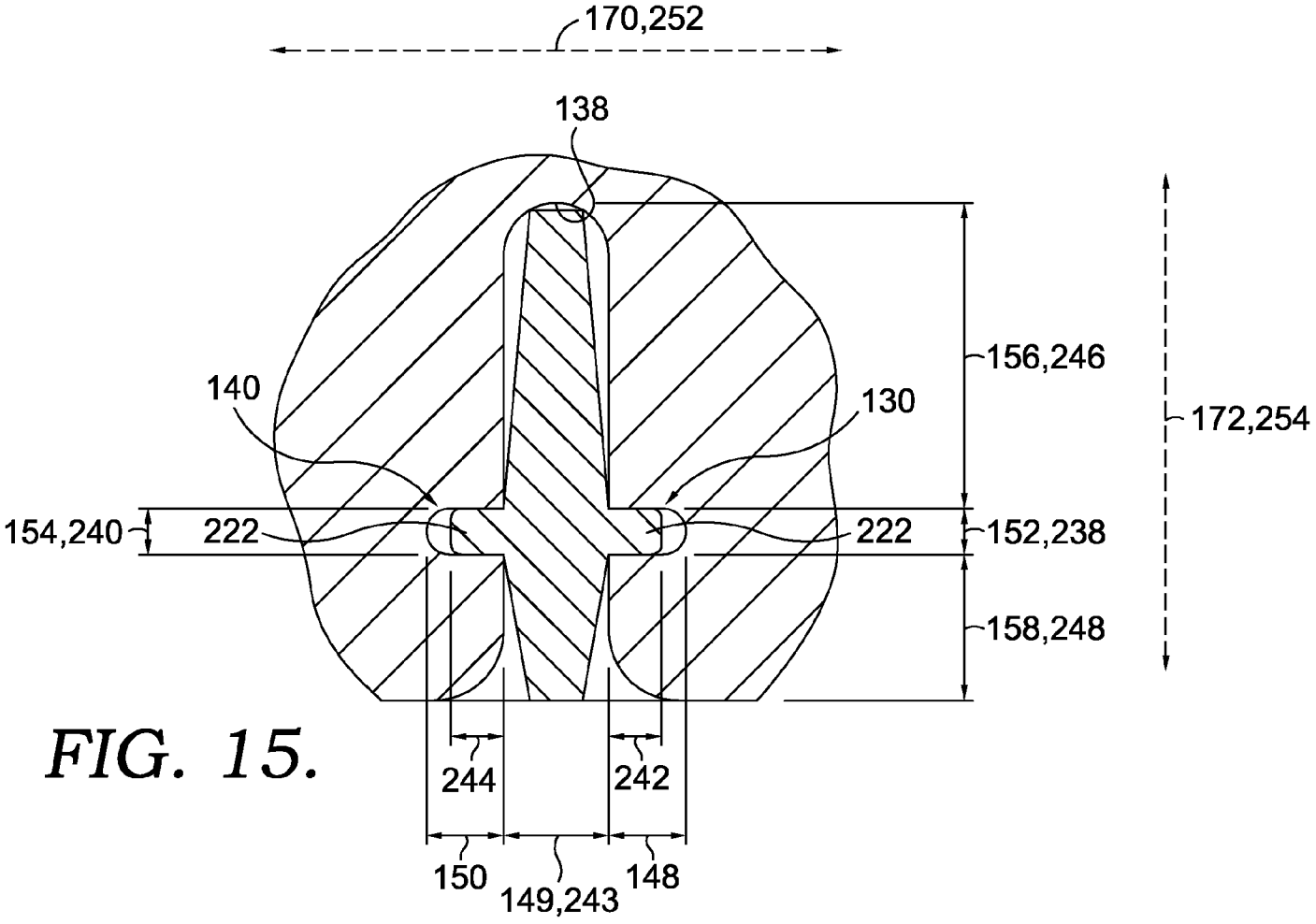
FIG. 15 depicts an enlarged view of a portion of the cross-section of FIG. 13, in accordance with an exemplary aspect hereof.

Turning now to FIG. 13, a cross-section view of the stability element body 202 coupled with the sole 102, as pictured in FIG. 12, is provided. FIGS. 14-15 provide an expanded view of portions of FIG. 13. In particular, FIG. 14 provides an enlarged, cross-section view of the stability element body 202 coupled with the sole 102 at the medial-side portion 119 of the receiving channel 116, and FIG. 15 provides an enlarged, cross-section view of the stability element body 202 coupled with the sole 102 at the lateral-side portion 121 of the receiving channel 116.

As has been mentioned, the sole 102 may be formed of a flexible and/or deformable material, and the stability element body 202 may be formed of a substantially rigid material. As such, when the sole 102 receives the stability element body 202 at the receiving channel 116, various portions of the receiving channel 116 may be deformed (e.g., stretched, compressed, molded, or any other means of deformation) due to forces exerted on the material of the sole 102 by the stability element body 202. As such, the receiving channel 116 may accommodate the stability element body 202.

A number of exemplary aspects depicted in FIGS. 13-15 may ensure that the stability element body 202 is securely coupled with the sole 102, such that the two components do not become uncoupled during use in conjunction with a clipless pedal. For example, as shown in FIGS. 14-15, the vertical distance 156 may be approximately equal to the vertical distance 246. As explained with respect to FIGS. 4-5, the vertical distance 156 is measured between the outer groove top 162 and the top surface 138 of the receiving channel 116. As explained with respect to FIG. 8, the vertical distance 246 is measured between the outer tongue top 258 and the stability element body top surface 212. When these distances are approximately equal to one another, the top portion of the stability element body 202 (the portion measured by the distance 246) may fit snuggly in the top portion of the receiving channel 116 (the portion measured by the distance 156). In other exemplary aspects, the top portion of the stability element body 202 may be larger or smaller than the top portion of the receiving channel 116. In such aspects, the receiving channel 116 may be deformed due to forces exerted by the stability element body 202. For example, if the top portion of the stability element body 202 is larger than the top portion of the receiving channel 116, the top surface 138 of the receiving channel 116 may be pushed upward by the stability element body 202, such that top portion of the stability element body 202 appears to be approximately the same size as the top portion of the receiving channel 116.

Figure 16:
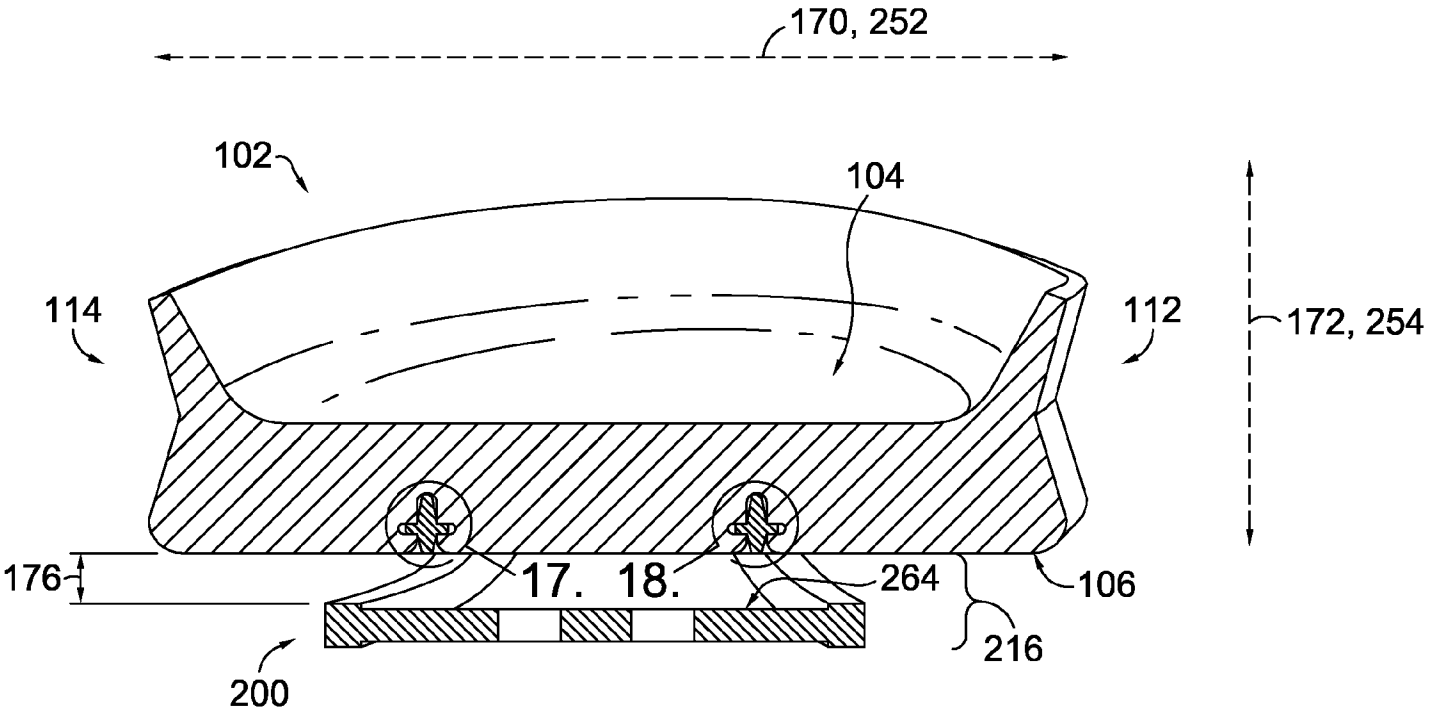
FIG. 16 depicts a cross-section view of the sole and stability element of FIG. 12, where the cross-section view is in the direction of the toe end of the sole and the toe end of the stability element, in accordance with an exemplary aspect hereof.
Figure 17:
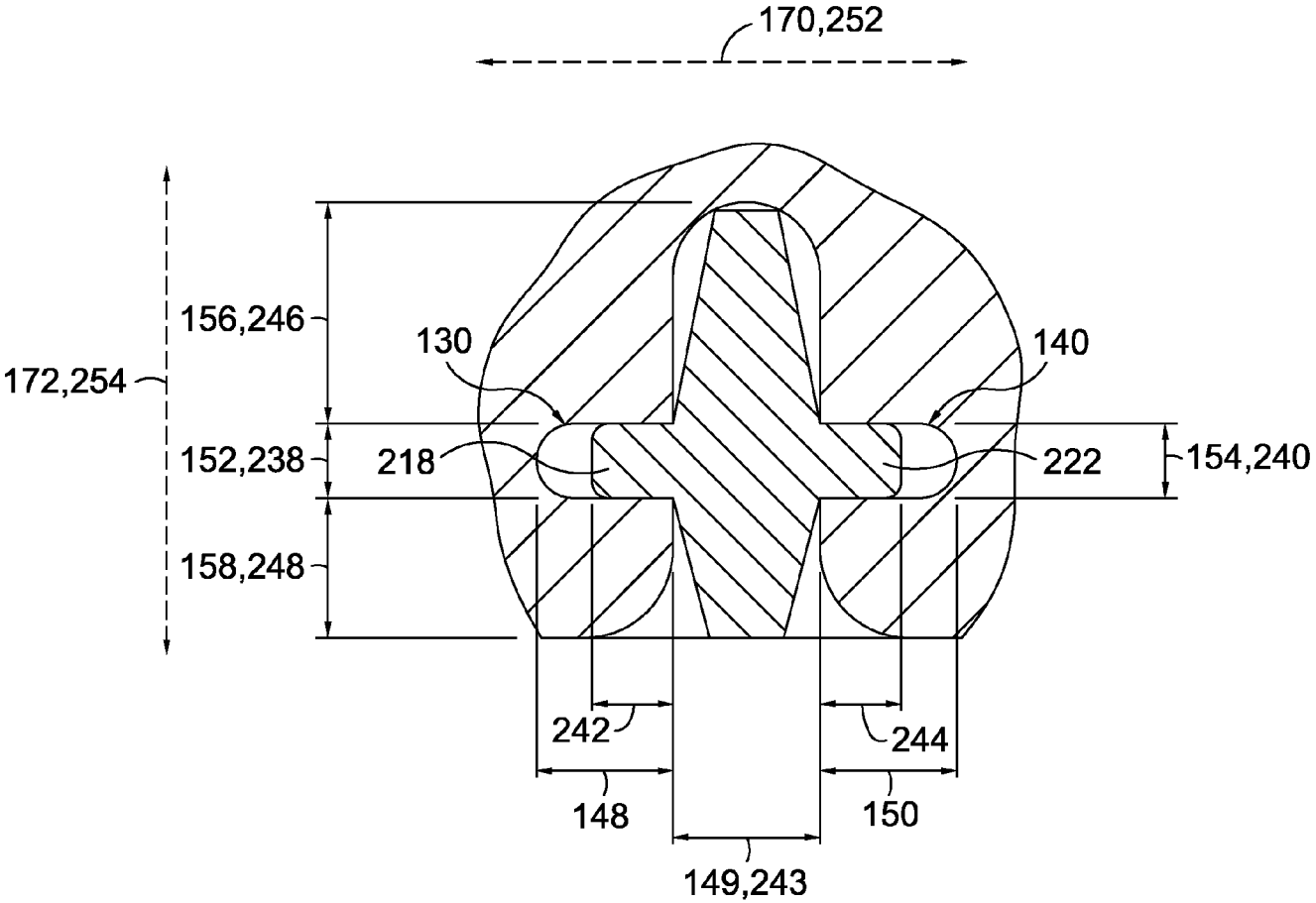
FIG. 17 depicts an enlarged view of a portion of the cross-section of FIG. 16, in accordance with an exemplary aspect hereof.
Figure 18:
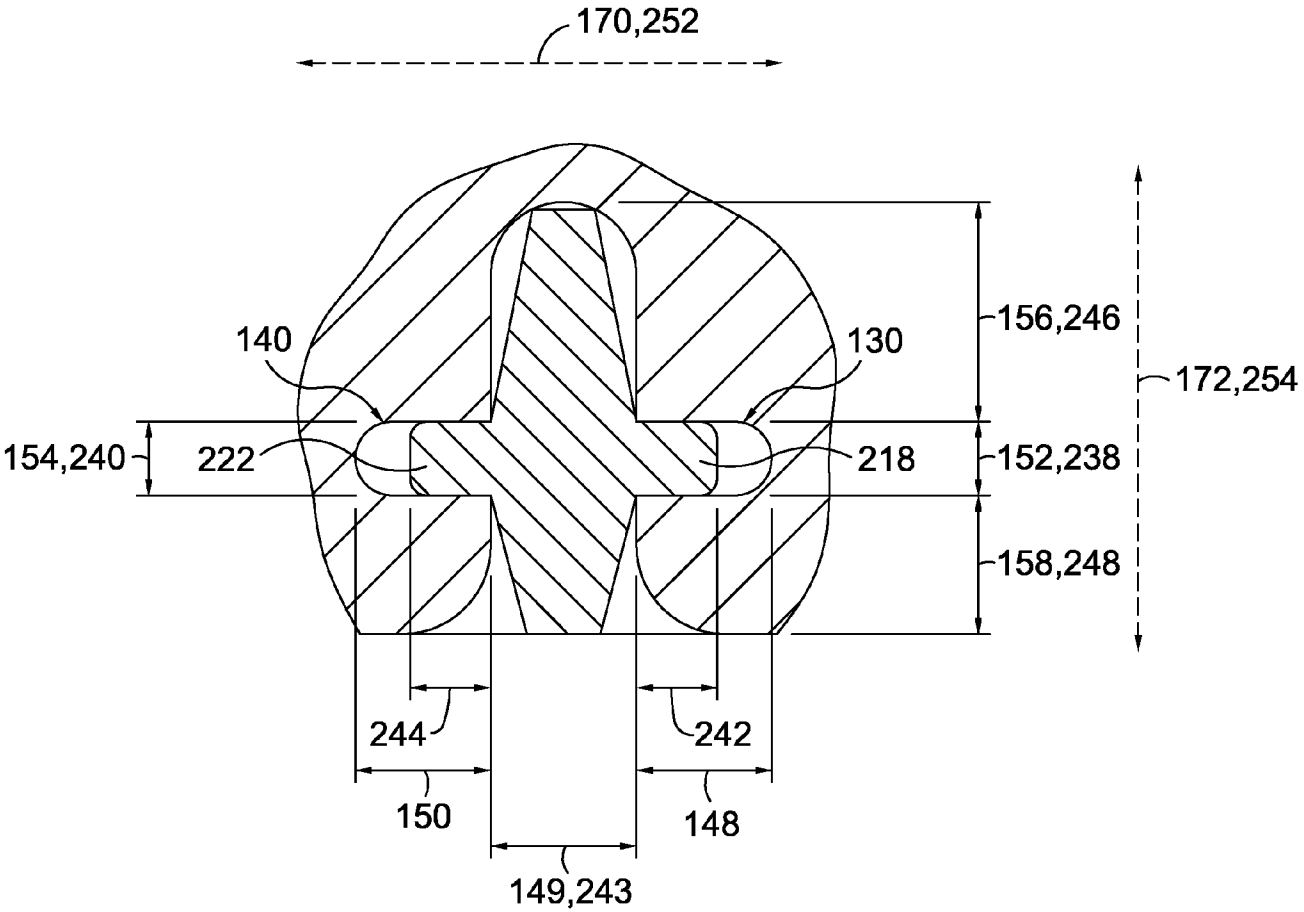
FIG. 18 depicts an enlarged view of a portion of the cross-section of FIG. 16, in accordance with an exemplary aspect hereof.

Also, as shown in FIGS. 14-15, the distances 158 and 248 may be substantially equal to one another. The distance 158 corresponds to a vertical distance between the sole bottom surface 106 and the outer groove bottom 160, as explained with respect to FIGS. 4-5. And as explained in regards to FIG. 8, the vertical distance 248 is measured between the stability element body bottom surface 214 and the outer tongue bottom 256. As illustrated in the figures, the stability element body 202 may be disposed completely within the receiving channel 116, such that the stability element body bottom surface 214 sits flush (or even recessed) with the sole bottom surface 106. This exemplary feature is also illustrated in FIGS. 16-18, which include cross-section views taken closer to the toe end 108. The proportions of the receiving channel 116 and the stability element body 202 may vary in accordance with one another along the axes 168 and 250, respectively, such that the entirety of the stability element body 202 may be disposed within the receiving channel 116, even as the total height of each component changes.

Turning now to the grooves and tongues, the outer groove height 152 may be approximately equal to, or less than, the outer tongue height 238. Likewise, the inner groove height 154 may be approximately equal to, or less than, the inner tongue height 240. If, for example, the groove heights are less than the corresponding tongue heights, the grooves may be deformed due to force exerted by the tongues, such that the tongues fit securely within the grooves. In particular, the outer tongue top 258 may exert a force on the outer groove top 162, and the outer tongue bottom 256 may exert a force on the outer groove bottom 160. A similar interaction may occur between the inner tongue 222 and the inner groove 140. This compression fit may be desirable for purposes of securing the tongues within the grooves. When the tongues are coupled with the grooves, as in FIGS. 14-15, the tongue heights 238 and 240 may appear to be approximately the same as the groove heights 152 and 154, respectively, but such appearance may be due to deformation of the sole 102 at the grooves.

The groove widths 148 and 150 may be wider than the tongue widths 242 and 244, respectively. This exemplary configuration, which is illustrated in FIGS. 14-15, may prevent a buckling effect that might cause the stability element body 202 to pop out of the receiving channel 116. In other words, if the tongue widths 242 and 244 are too wide, as compared to the groove widths 148 and 150, respectively, compression forces may cause the tongues 218 and 222 to become dislodged from the grooves 130 and 140. This type of compression force may undermine the secure coupling of the stability element body 202 to the sole 102 at the receiving channel 116, and may therefore be undesirable. As illustrated by the preceding discussion of the relative widths and heights of various portions of the stability element body 202 and the receiving channel 116, including the grooves and tongues, the dimensions of these various components may be optimized for purposes of creating a compression fit between the receiving channel 116 and the stability element body 202, such that the stability element body 202 is securely retained by the receiving channel 116 when the shoe 100 is used in conjunction with a clipless pedal.

In further exemplary aspects, the width 149 of the body portion 174 of the receiving channel 116 may be approximately equal to the width 243 of the stability element body 202. In other aspects, the body portion width 149 may be less than the stability element body width 243. Even so, as mentioned above, when the stability element body 202 is coupled to the receiving channel 116, these widths may appear to be approximately the same due to deformation of the sole at the receiving channel 116. The relative widths of these components may provide for secure coupling between the receiving channel 116 and the stability element body 202.

Finally, the exemplary cross-section view of FIG. 16 shows the clip receiving portion 216 when the stability element 200 is coupled with the sole 102. In particular, FIG. 16 shows the clip receiving portion 216 extending away from the bottom surface 106 of the sole 102 in the direction of the vertical axes 172 and 254. The distance 176 between the sole bottom surface 106 and the top surface 264 of the clip receiving portion 216 may, in an exemplary aspect, satisfy a minimum threshold distance. This threshold distance may be between approximately 0.5 and 5 centimeters. In an exemplary aspect, the distance 176 may be, at least, 2 centimeters.

From the foregoing, it will be seen that aspects hereof are well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible aspects may be implemented without departing from the scope hereof, it is to be understood that all matter herein set forth or shown in the accompanying drawings is to be interpreted as illustrative and not in a limiting sense.

What is claimed is:

1. An article of footwear comprising:

a sole having a ground contacting surface, a top surface opposite the ground contacting surface, and a continuous receiving channel extending through the ground contacting surface toward the top surface and separating an outer portion of the ground contacting surface from an inner portion of the ground contacting surface, the continuous receiving channel having a first groove at an outer perimeter of the continuous receiving channel and a second groove at an inner perimeter of the continuous receiving channel; and a stability element, the stability element having a first tongue protruding from an outer perimeter of a body of the stability element and a second tongue protruding from an inner perimeter of the body of the stability element, wherein the first groove of the continuous receiving channel is configured to receive the first tongue of the stability element and the second groove of the continuous receiving channel is configured to receive the second tongue of the stability element as the stability element is maintained, at least in part, within the continuous receiving channel, wherein the stability element is configured to permit at least a first portion of the outer portion of the ground contacting surface and at least a second portion of the inner portion of the ground contacting surface to contact a ground surface when the stability element is received within the continuous receiving channel and the article of footwear is in an as-worn position.

2. The article of footwear of claim 1, wherein the first groove comprises a first groove bottom surface, a first groove recessed surface, and a first groove top surface, wherein the first groove recessed surface is recessed from the outer perimeter of the continuous receiving channel, between an upper portion of the outer perimeter of the continuous receiving channel and a lower portion of the outer perimeter of the continuous receiving channel, by a first groove width.

3. The article of footwear of claim 2, wherein the first tongue comprises a first tongue bottom surface, a first tongue protruded surface, and a first tongue top surface, wherein the first tongue protruded surface protrudes from the outer perimeter of the body of the stability element, between an upper portion of the outer perimeter of the body of the stability element and a lower portion of the outer perimeter of the body of the stability element, by a first tongue width.

4. The article of footwear of claim 3, wherein a first groove height is equal to or less than a first tongue height to effectively apply a compressive force on to the first tongue when maintained.

5. The article of footwear of claim 3, wherein the first groove width is greater than the first tongue width.

6. The article of footwear of claim 5, wherein the second groove comprises a second groove bottom surface, a second groove recessed surface, and a second groove top surface, wherein the second groove recessed surface is recessed from the inner perimeter of the continuous receiving channel, between an upper portion of the inner perimeter of the continuous receiving channel and a lower portion of the inner perimeter of the continuous receiving channel, by a second groove width.

7. The article of footwear of claim 6, wherein the second tongue comprises a second tongue bottom surface, a second tongue protruded surface, and a second tongue top surface, wherein the second tongue protruded surface protrudes from the inner perimeter of the body of the stability element, between an upper portion of the inner perimeter of the body of the stability element and a lower portion of the inner perimeter of the body of the stability element, by a second tongue width.

8. The article of footwear of claim 7, wherein a second groove height is equal to or less than a second tongue height.

9. The article of footwear of claim 7, wherein the second groove width is greater than the second tongue width.

10. An article of footwear comprising:

a sole comprising:

a sole toe end opposite a sole heel end, a ground contacting surface having an outer portion surrounding an inner portion, and an elongated receiving channel extending into the sole through the ground contacting surface and separating the outer portion from the inner portion, the elongated receiving channel comprising:

a receiving channel toe end portion disposed at the sole toe end;

a receiving channel heel end portion disposed at the sole heel end;

a receiving channel outer edge including a first groove; and a receiving channel inner edge including a second groove; and an elongated stability element comprising:

a stability element body having a stability element toe end portion, a stability element heel end portion, and a clip receiving portion, and a first tongue protruding from an outer peripheral surface of the stability element body and a second tongue protruding from an inner peripheral surface of the stability element body, wherein the elongated receiving channel is configured to receive the stability element body such that the stability element toe end portion is disposed at the receiving channel toe end portion and the stability element heel end portion is disposed at the receiving channel heel end portion, wherein the first groove of the receiving channel outer edge is configured to receive the first tongue protruding from the outer peripheral surface of the stability element body and the second groove of the receiving channel inner edge is configured to receive the second tongue protruding from the inner peripheral surface of the stability element body, and wherein when the stability element body is fully received within the elongated receiving channel only the clip receiving portion extends out of the continuous receiving channel beyond the ground contacting surface.

11. The article of footwear of claim 10, wherein the elongated receiving channel receives the stability element body from the ground contacting surface of the sole inward, toward a top surface of the sole.

12. An article of footwear comprising:

a sole having a top surface opposite of a ground contacting surface, a heel end and an opposite toe end, a medial side and an opposite lateral side, the sole comprising:

a continuous receiving channel extending into the sole through the ground contacting surface, separating an outer portion of the ground contacting surface from an inner portion of the ground contacting surface, and extending between the toe end and the heel end and between the medial side and the lateral side, the continuous receiving channel comprising a body portion and an outer perimeter groove, the outer perimeter groove extending closer to the sole lateral side and the sole medial side than the body portion extends to the sole lateral side and the sole medial side; and a stability element having a body with a toe end and an opposite heel end, a medial side and an opposite lateral side, and a top surface and an opposite bottom surface, the stability element comprising:

a clip receiving portion extending from the body between the toe end and the heel end at the bottom surface of the stability element body, and an outer tongue protruding from an outer peripheral surface of the stability element body between the top surface and the bottom surface of the stability element body, the outer tongue is configured to be received in the outer perimeter groove when the stability element is coupled with the sole at the continuous receiving channel, wherein when the stability element is received within the continuous receiving channel, only the clip receiving portion extends out of the continuous receiving channel beyond the ground contacting surface.

13. The article of footwear of claim 12, wherein a difference between a distance by which the outer perimeter groove extends to the sole lateral side and the sole medial side, and a distance by which the body portion extends to the sole lateral side and the sole medial side, corresponds to an outer perimeter groove width.

14. The article of footwear of claim 13, wherein a distance by which the outer tongue protrudes from the outer peripheral surface of the stability element body corresponds to an outer tongue width, wherein the outer tongue width is less than the outer perimeter groove width.

15. The article of footwear of claim 12, wherein:

the continuous receiving channel further comprises an inner perimeter groove, the inner perimeter groove extending closer to the sole lateral side and the sole medial side than the body portion extends to the sole lateral side and the sole medial side; and the stability element further comprises an inner tongue protruding from an inner peripheral surface of the stability element body between the top surface and the bottom surface of the stability element body.

16. The article of footwear of claim 12, wherein a height from a top of the outer perimeter groove to a top surface of the continuous receiving channel is substantially equal to a height from a top of the outer tongue to the top surface of the stability element body.

17. The article of footwear of claim 16, wherein a height from the ground contacting surface to a bottom of the outer perimeter groove is substantially equal to a height from the stability element body bottom surface to a bottom of the outer tongue.

18. The article of footwear of claim 12, wherein the clip receiving portion extends laterally away from the stability element body, extends vertically away from the stability element body bottom surface, and extends vertically away from the ground contacting surface when the stability element body is coupled with the sole at the continuous receiving channel.

19. The article of footwear of claim 18, wherein, when the stability element body is coupled with the sole at the continuous receiving channel, a distance between the ground contacting surface and the clip receiving portion is at least 0.5 centimeters.

20. The article of footwear of claim 12, wherein the sole comprises a deformable material and the stability element comprises a substantially rigid material.

* * * * *